US009989929B2

(12) United States Patent
Kahn et al.

(10) Patent No.: US 9,989,929 B2
(45) Date of Patent: Jun. 5, 2018

(54) USER INTERFACE FOR A MULTI-PURPOSE BAND

(71) Applicants: Philippe Richard Kahn, Santa Cruz, CA (US); Arthur Kinsolving, Santa Cruz, CA (US)

(72) Inventors: Philippe Richard Kahn, Santa Cruz, CA (US); Arthur Kinsolving, Santa Cruz, CA (US)

(73) Assignee: DP Technologies, Inc., Scotts Valley, CA (US)

( * ) Notice: Subject to any disclaimer, the term of this patent is extended or adjusted under 35 U.S.C. 154(b) by 0 days. days.

(21) Appl. No.: 14/732,668

(22) Filed: Jun. 5, 2015

(65) Prior Publication Data

US 2015/0355603 A1 Dec. 10, 2015

Related U.S. Application Data

(60) Provisional application No. 62/008,502, filed on Jun. 5, 2014.

(51) Int. Cl.
*G04G 9/04* (2006.01)

(52) U.S. Cl.
CPC ..... *G04G 9/047* (2013.01); *G04G 9/042* (2013.01)

(58) Field of Classification Search
CPC ..... G04G 21/00; G04G 21/04; G04G 9/04; G04G 9/042; G04G 9/047
USPC ..... 368/241–242
See application file for complete search history.

(56) References Cited

U.S. PATENT DOCUMENTS

| | | | | |
|---|---|---|---|---|
| 5,526,327 | A * | 6/1996 | Cordova, Jr. | G04G 9/02 368/223 |
| 5,896,348 | A * | 4/1999 | Lyon | G04G 9/02 368/223 |
| 6,882,597 | B2 * | 4/2005 | Kent | G04G 9/02 368/223 |
| 7,599,255 | B2 * | 10/2009 | Kent | G04G 9/02 368/82 |
| 9,192,326 | B2 * | 11/2015 | Kahn | G04G 13/026 |
| 2005/0052953 | A1 * | 3/2005 | Kent | G04G 9/02 368/82 |
| 2005/0185519 | A1 * | 8/2005 | Kent | G04G 9/02 368/239 |
| 2006/0092768 | A1 * | 5/2006 | Demas | G04B 19/22 368/21 |
| 2006/0092769 | A1 * | 5/2006 | Demas | G04B 19/22 368/82 |
| 2006/0126439 | A1 * | 6/2006 | Kent | G04G 9/02 368/82 |
| 2007/0147181 | A1 * | 6/2007 | Piccirillo | G04G 9/042 368/223 |
| 2009/0059730 | A1 * | 3/2009 | Lyons | G04G 21/04 368/69 |
| 2013/0018284 | A1 * | 1/2013 | Kahn | G04G 13/026 600/595 |

* cited by examiner

*Primary Examiner* — Sean Kayes
(74) *Attorney, Agent, or Firm* — HIPLegal LLP

(57) ABSTRACT

A method and apparatus to provide a user interface for a multi-purpose band is described. The user interface includes two shapes, in one embodiment, each shape made up of a plurality of LEDs or other light sources. Multiple types of information may be provided to the user through the lights, including activity statistics, sleep statistics, and current time.

19 Claims, 11 Drawing Sheets

| State | Shape #1 | Shape #2 |
|---|---|---|
| Active (v1) | Percent of active steps to goal | Percent of aerobic steps to goal |
| Active (v2) | Percent of lap time this lap | Overall lap time compared to user goal |
| Active (v3) | Elevation reached | Percent of activity level total |
| Active (v4) | Miles run | Percent at goal speed |
| Active (v5) | Percent of day active | Relationship to goal |
| Sleep (v1) | Progress to goal time of sleep | Sleep efficiency |
| Sleep (v2) | Percent of sleep in deep sleep | Snoring level |
| Sleep (v3) | Restfulness of sleep | Time left to waking up |
| Clock (v1) | Minutes | Hours |
| Clock (v2) | Timer set | Time left on timer |
| Clock (v3) | Countdown time left | Activity evaluation |

Figure 5

USER INTERFACE FOR A MULTI-PURPOSE BAND

RELATED APPLICATIONS

The present application claims priority to U.S. Provisional Application No. 62/008,502 filed on Jun. 5, 2014, and incorporates that application in its entirety.

FIELD

The present invention relates to a user-worn device, and more particularly to a user interface for a multi-purpose device.

BACKGROUND

User interfaces differ in the information and visual attractiveness. Generally, user interfaces are designed to utilize either one or more LEDs (light emitting diodes) or an LCD (liquid crystal display). For the most part, the information conveyed by an LED-based user interface is very limited, while an LCD can provide more information, but is more fragile and costly.

BRIEF DESCRIPTION OF THE FIGURES

The present invention is illustrated by way of example, and not by way of limitation, in the figures of the accompanying drawings and in which like reference numerals refer to similar elements and in which:

FIG. 5 is a table of an embodiment of some of the data the user interface can present in various states.

DETAILED DESCRIPTION

The user interface provided for a multi-use user-worn device enables the conveying of complex and detailed information using the limited display capabilities provided by a small number of LEDs (light emitting diodes) or other light sources, such as OLED (organic LED), PLED (polymer LED) or other technologies which provide small lights. In one embodiment, the user interface includes two concentric shapes of LEDs, and a central image or display, which provides state data to the user. The shapes may be circles, squares, diamonds, arcs, or other polygon or curvilinear shapes. In another embodiment, the user interface may be two non-concentric shapes, for example an upper and lower arch, together forming a shape.

The user interface, in one embodiment, can provide a variety of information, such as the user's progress toward a goal, or current status, as well as the current time, and other relevant information. In one embodiment, the colors of the LEDs may be used to provide further fine-grained information. In one embodiment, there are 24 LEDs, and some or all of the LEDs are multi-color LEDs. In another embodiment, each "LED" consists of a plurality of LEDs which are output through a single "light" location. In embodiment, the center image is a cut-out lit via an LED, to indicate the current state of the device and/or the user. In one embodiment, those states may be active, sleeping, or clock display. In one embodiment, an additional state may be "inactive" in which the LEDs are turned off to save power, and no data is displayed.

The following detailed description of embodiments of the invention makes reference to the accompanying drawings in which like references indicate similar elements, showing by way of illustration specific embodiments of practicing the invention. Description of these embodiments is in sufficient detail to enable those skilled in the art to practice the invention. One skilled in the art understands that other embodiments may be utilized and that logical, mechanical, electrical, functional and other changes may be made without departing from the scope of the present invention. The following detailed description is, therefore, not to be taken in a limiting sense, and the scope of the present invention is defined only by the appended claims.

Figure 1A:
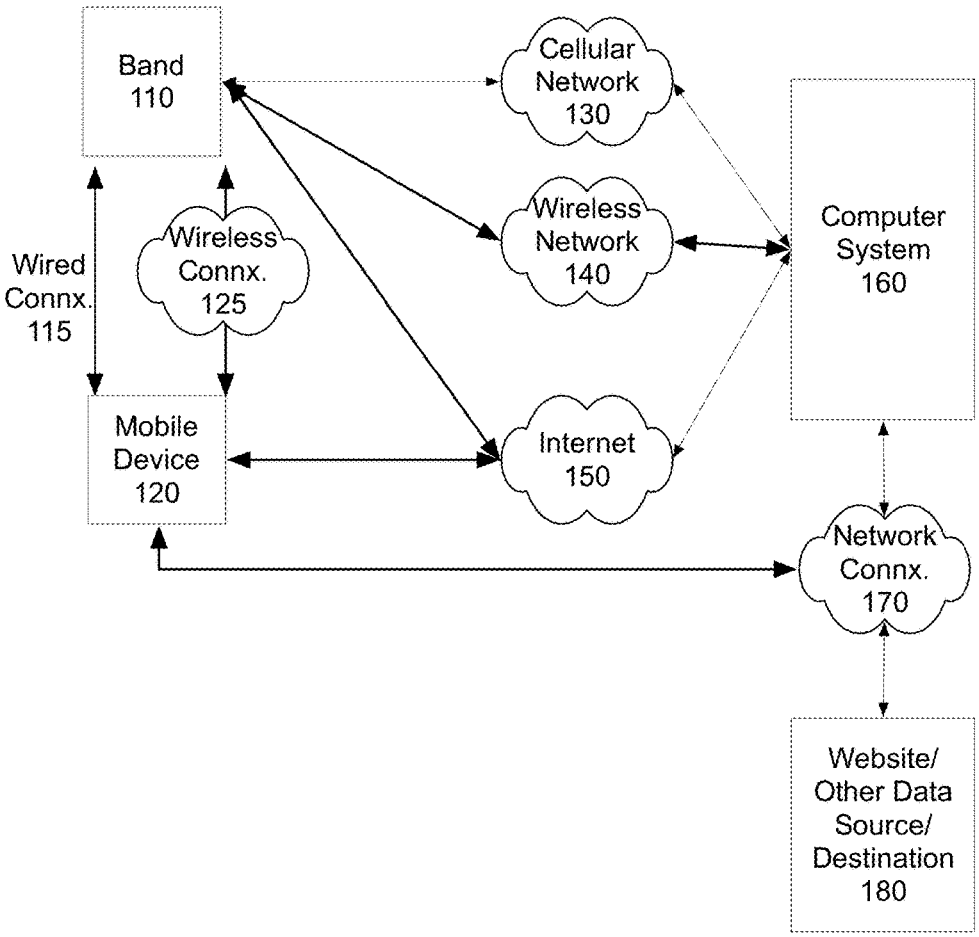
FIG. 1A is a block diagram of one embodiment of a network including the band.

FIG. 1 is a block diagram of one embodiment of a network including the user-worn device. For simplicity the device will be referred to as a "band." It should be understood that the configuration may be a watch face (in a watch band), a clip-on or similar display, a bracelet or similar configuration, or any other device which is worn by a user and where the user can see the display. In one embodiment, the band 110 interfaces with a mobile device 120 such as a smart phone, tablet, or similar device, via a wireless 125 or wired 115 connection. The wireless connection 125 may be a Bluetooth connection. The band 110 may also interface with a computer system 160 via various connection mechanisms, which may be wired or wireless. In one embodiment, the computer system 160 may receive data directly from the band 110, or from the mobile device 120, which receives data from the band 110.

In one embodiment, computer system 160 and/or mobile device 120 may obtain data from and/or provide data to other websites, data sources, or servers 180, via network connection 170. This enables the band 110 to be updated, to collect cumulative data, and to provide other services. Furthermore, it enables the system to provide more complex and detailed data via the user interface of a device such as mobile device 120 or computer system 160.

Figure 1B:
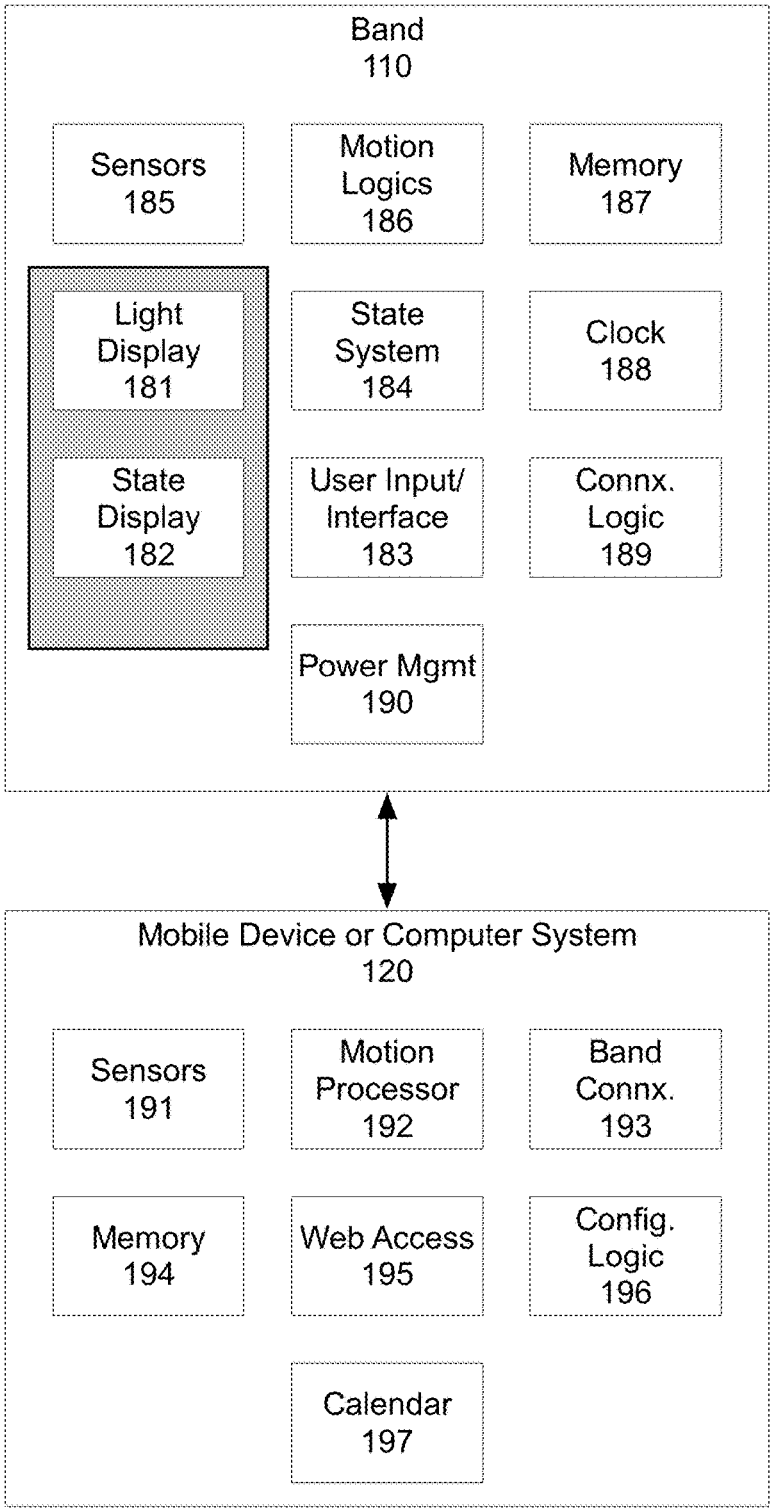
FIG. 1B a block diagram of one embodiment of the band system, including a user interface.

FIG. 1B is a block diagram of one embodiment of the band including user interface. The band 110 includes one or more sensors 185. These sensors may include accelerometers, gyroscopes, or other movement sensors, temperature sensors, microphones or other sound sensors, etc. Motion logics 186 process the sensor data to identify the user's motion state. In one embodiment, motion logics 186 may further process the motion and other sensor data to determine activity and activity level, identify times when the user needs to get up and stretch or perform another ergonomic activity, sleep and sleep state, etc. In one embodiment, this data is stored in memory 187. In one embodiment, this data is shared with a mobile device 120 or other computer system (not shown) via connection logic 189. In one embodiment, while motion logic 186 in band provides some calculations, any complex calculations are performed on the mobile device 120 or computer system, and the result of those calculations is provided back to the band, via connection logic 189. Connection logic 189 may be a low power wireless connection such as Bluetooth BLE.

State system 184 uses the data from motion logics 186 and optionally mobile device 120 or computer system to determine a current state for the band 110. In one embodiment, the band states may be active, sleeping, clock (e.g. inactive but awake). FIG. 5 is a table of exemplary states, and some associated displays on the band 110.

State display 182 indicates the current state, as determined by state system 184. Light display 181 includes two or more shapes including a plurality of light sources, to display information about the user or band, in the current state. FIG. 5 illustrates some exemplary displays which may be shown by light display 181. Together, light display 181 and state display 182 are a user interface display.

Use input/interface 183 enables the user to input information into the band 110. In one embodiment, more complex data is entered via the mobile device 120 or computer system's configuration logic 196. However, simple commands, such as changing state, or changing the display for the current state, may be entered via user input/interface 183. User input/interface 183 may be a motion interface, enabling the user to utilize motion commands. Alternatively, or additionally, one or more buttons may be used. User input/interface 183, along with light display 181 and state display 182 together form the user interface for the band 110.

In one embodiment, the system includes a block 188. In one embodiment, clock 188 may be maintained on the band 110. In one embodiment, clock 188 may be synchronized through mobile device 120, to ensure that the clock reflects the current time. Clock 188 is used for clock display. In one embodiment, clock display includes information from the user's calendar 197, on mobile device 120 or computer system, obtained via connection logic 189.

Power management 190 controls the user interface display, and optionally sensors 185. It enables the system to reduce power consumption by turning of the display when the user is not wearing the device, and reducing light intensity when appropriate. In one embodiment, a light level sensor in sensors 185 may be used to adjust light intensity. In one embodiment, light level sensors may be among the sensors 191 in mobile device or computer system 120, and band 110 may receive this data. Power management 190 also may turn off one or more of the sensors 185, when the device is not being worn. In one embodiment, the system may reduce the frequency of obtaining data by a sensor, rather than turning it off. In one embodiment, when the band 110 is not being worn, the system may periodically test for motion or temperature, but otherwise keep the sensors and processors in an off or low power consumption state.

Mobile device or computer system 120 may include one or more sensors 191, and motion processor 192. Motion processor 192 may be used to determine motion state, calculate additional data about the user's movements, etc. Band connection 193 provides data to the band 110, automatically or upon request.

Web access 195, in one embodiment, enables the device to get information from third parties, or provide information to third parties.

Figure 2A:
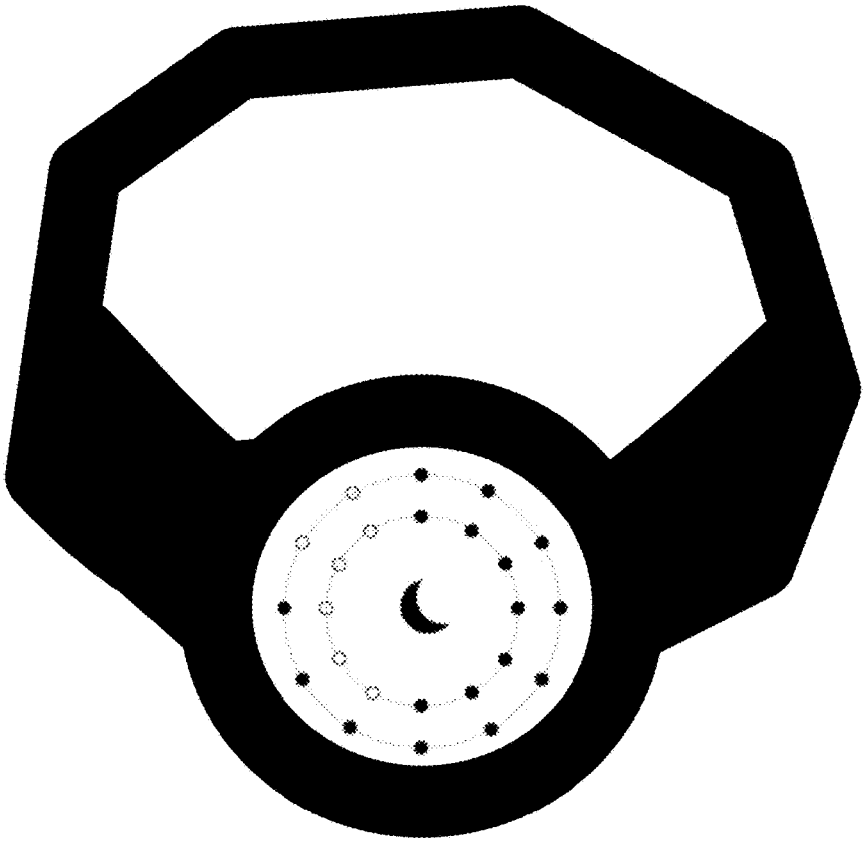
FIGS. 2A-2B are exemplary bands including one embodiment of the user interface of the present invention.
Figure 2B:
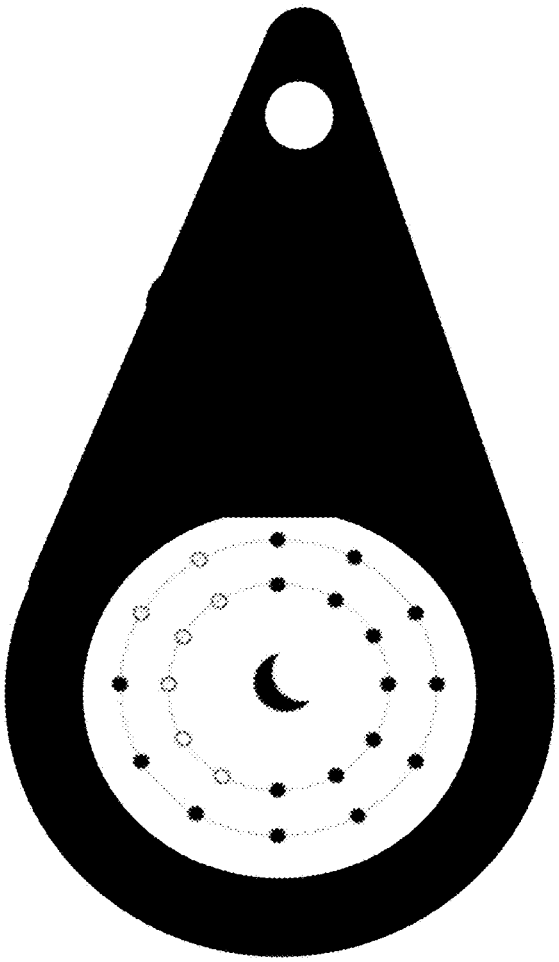

FIGS. 2A-2B are exemplary bands including one embodiment of the user interface of the present invention. FIG. 2A illustrates a band that may include the user interface. This band may be a multifunction band, such as the band described in co-pending application U.S. Ser. No. 12/819,195, filed Jun. 19, 2010, entitled "Method and Apparatus to Provide Monitoring," incorporated herein by reference. The band may alternatively be a traditional watch or similar configuration. The band may also appear different, for example, with a uniform thickness or with a particular shape. The small lights on the user interface may be implemented using LEDs (light emitting diodes) or other light sources. In one embodiment, the LEDs or other lights may be capable of displaying a plurality of colors. FIG. 2B illustrates the same user interface in a pod or pendant. Other formats such as rings, armbands, stick-ons, or other mechanisms to provide a user interface to a user may be utilized. In one embodiment, the user interface may be displayed as a projection, for example on glasses or another virtual display mechanism.

Figures 2C, 2D, 2E:
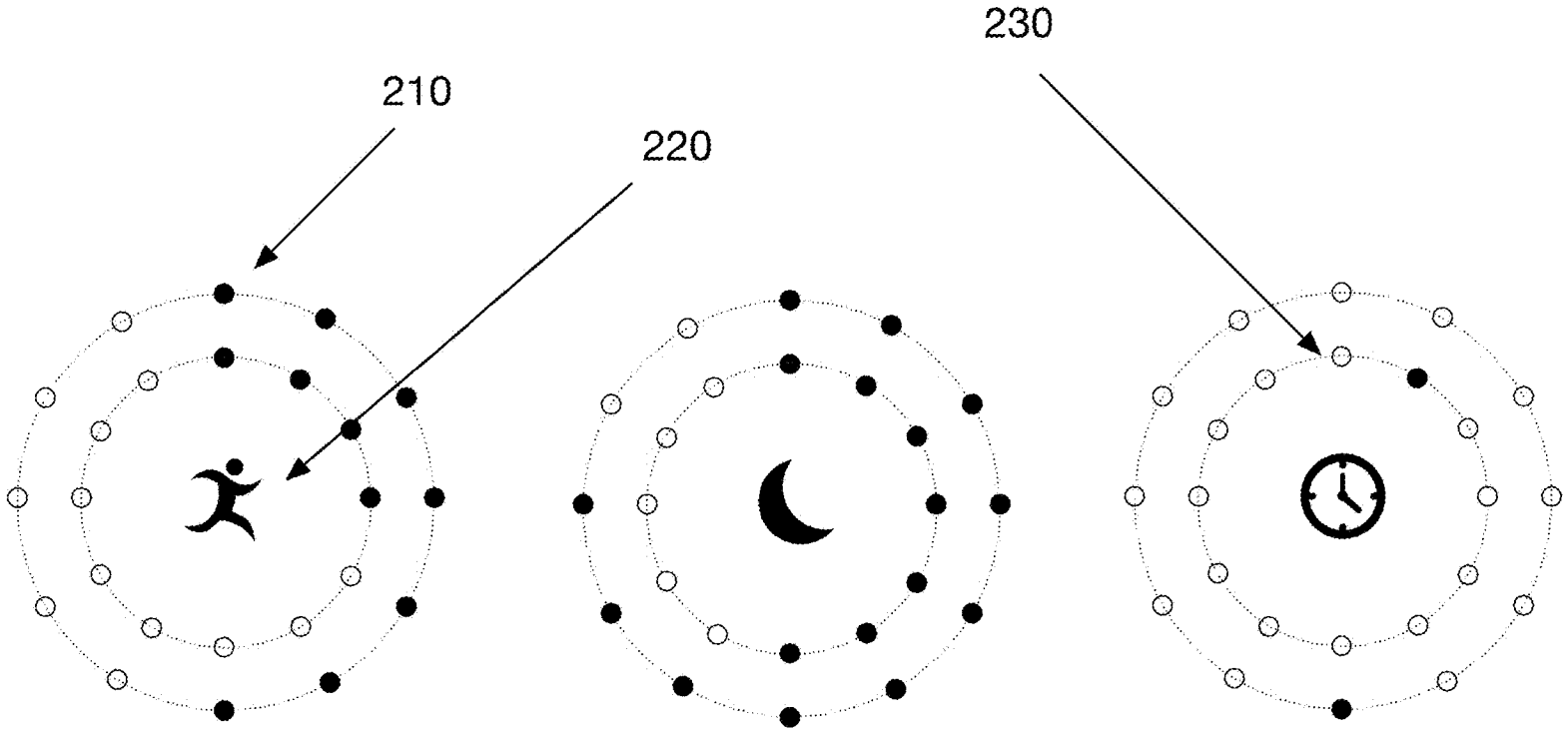
FIGS. 2C-2E illustrate various displays on the user interface, in one embodiment, for the different user interface states.

FIGS. 2C-2E illustrate various displays on the user interface, in one embodiment, for the different user interface states. In one embodiment, the user interface may operate in three distinct states, active, sleeping, and clock. In one embodiment, a state may have a particular set of outputs provided on the user interface. FIG. 5 is a table including some exemplary display content for various states.

In FIG. 2C, the active state, in one embodiment, the system displays the state indicator 220, here shown as a running man. The outer and inner ring both of the user interface provide relevant data to the user about his or her state. For example, as noted in FIG. 5, the outer ring may indicate what percentage of the user's goal of 10,000 steps were taken, while the inner ring may indicate how many aerobic steps were taken.

In one embodiment, the different rings may show unrelated data. For example, the outer ring may indicate the number of steps taken, while the inner ring is a count-down timer until the user should get up and stretch or otherwise perform some ergonomic activity.

In the sleep state, shown in FIG. 2D, the user's sleep data is presented. In one embodiment, the sleep data may include the percentage of the user's sleep goal, restfulness, sleep efficiency, etc. In one embodiment, the sleep state may include a count-down timer until the alarm will sound. In one embodiment, the system may not display state while the user is sleeping until the user presses a button or otherwise requests state, to save power and to avoid disturbing the sleep of the user.

FIG. 2E illustrates the clock state. In one embodiment, the outer ring indicates the minutes, while the inner ring indicates the hours. Note that although only 24 LEDs/lights are shown, in one embodiment, the configuration may include a larger number of lights, for example 60.

Figure 2F:
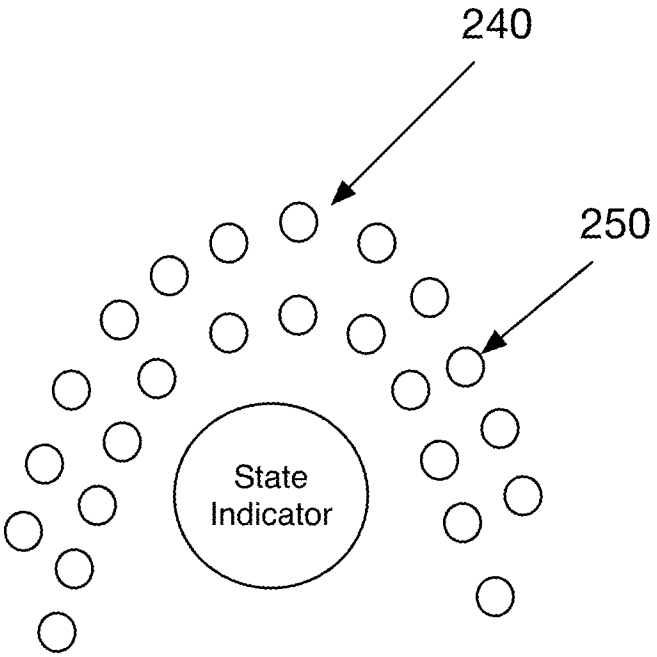
FIGS. 2F-2I illustrate alternative configurations of the user interface.
Figure 2G:
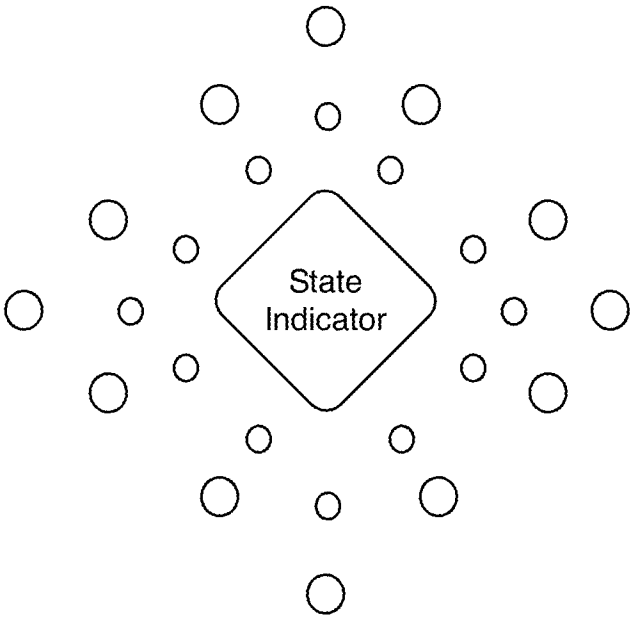
Figure 2I:
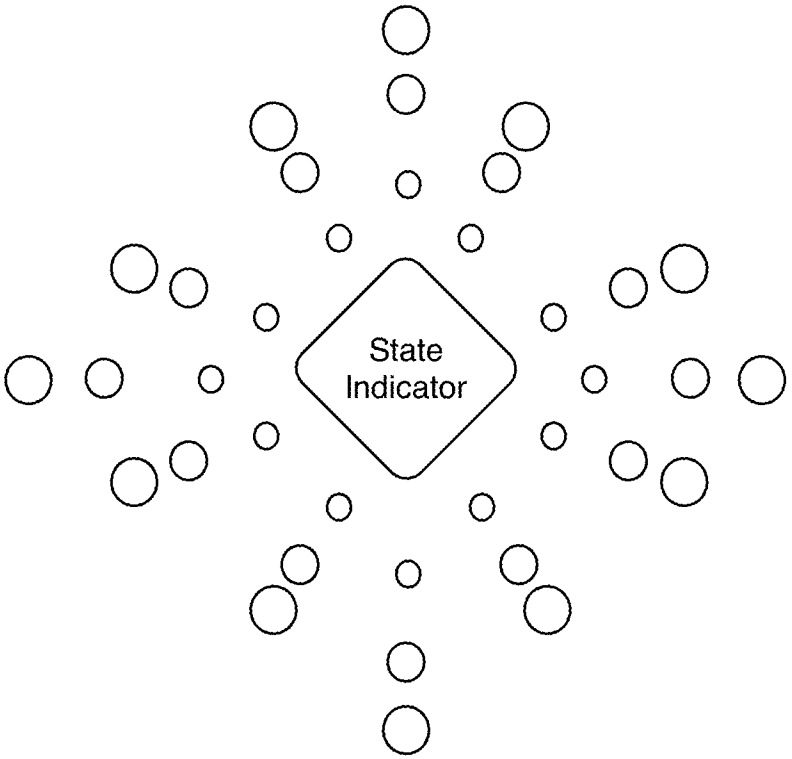
Figure 2H:
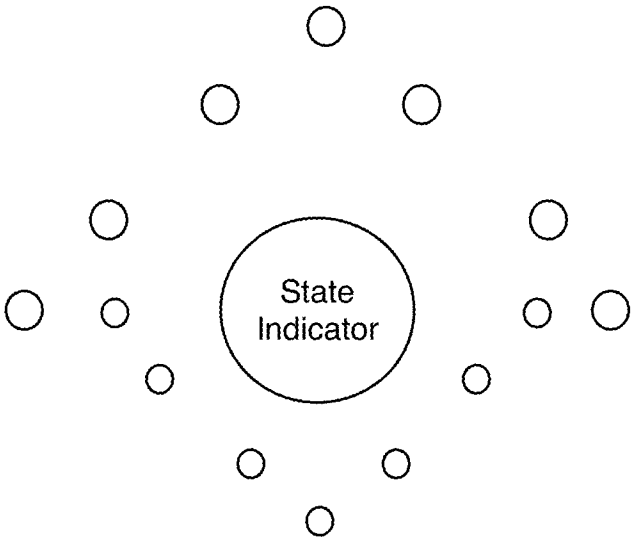

FIGS. 2F-2I illustrate alternative configurations of the user interface. In one embodiment, the user interface includes a state indicator, and two concentric shapes. Those shapes may be circles, as shown in FIGS. 2C-2E, arcs as shown in FIG. 2F, rectangles as shown in FIG. 2G, or other regular shapes. FIG. 2H illustrates another configuration, in which the two shapes are not concentric. Alternative configurations, in any shape that allows the distinguishing between the two types of indicators, may be utilized. In another embodiment, there may be a third shape, or more than three shapes in the system, for example, in a clock configuration there may be a shape for hours, minutes, and seconds. Additional data may be presented on a third, fourth, etc. shape. In one embodiment, the shapes may be different for each type of indication, e.g. a curved first shape and a polygonal second shape, etc.

Figure 3:
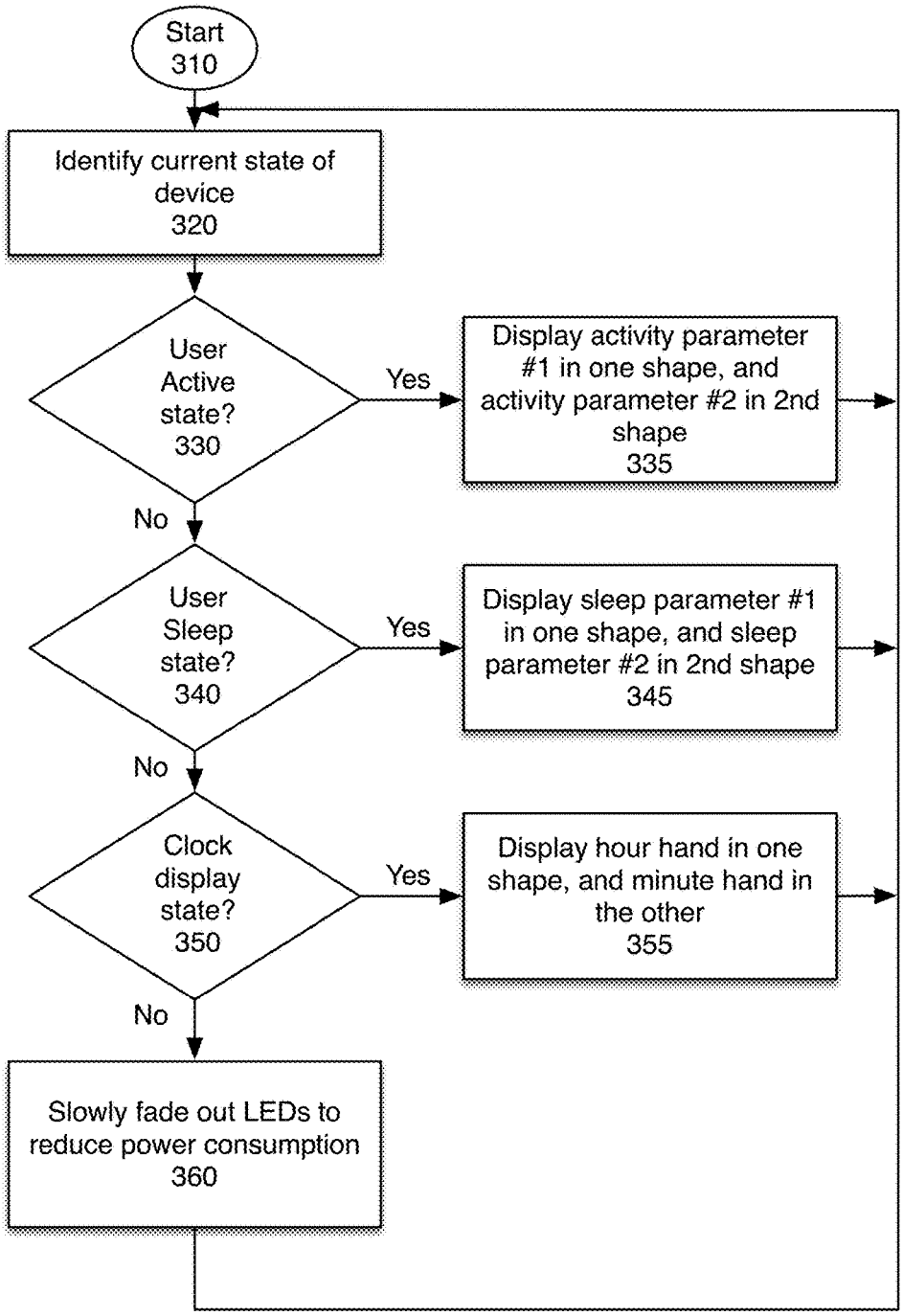
FIG. 3 is a flowchart of one embodiment of controlling the user interface.

FIG. 3 is a flowchart of one embodiment of controlling the user interface. The process starts at block 310. At block 320, the current state of the device is identified. In one embodiment, the state is identified based on one or more of motion data, time of day data, and user input.

At block 330, the process determines whether the device is in an active state. If so, a first activity parameter is displayed in one circle, and a second activity parameter is displayed in the second circle, at block 335. As noted above, the system may have additional circles, on which additional parameters, or further details for a parameter, may be displayed. Of course, while the term "circle" is used here, as discussed above, the display may be any shape, regular or irregular.

If the device is in a user sleep state, the sleep parameters are displayed, at block 345. In one embodiment, the sleep parameters may include length of time in bed, percentage of sleep goal met, percentage of sleep in deep sleep state, etc. Other types of sleep data may also be displayed. For example, an LED may be a different color for a period when the user was restless or when the user was snoring or some other factor was observed. In one embodiment, the LED display may enable the user to view the details of the relevant time period on a mobile device or computer system.

If the device is in a clock display state, at block 350, the hour hand is displayed in one circle, and the minute hand is displayed in the other, at block 355. In another embodiment, only the hour hand is displayed, and an alarm time is displayed in the other circle. In one embodiment, the second circle may display a time when the user has a scheduled activity, such as an appointment. This may enable the user to visually identify upcoming activities. In one embodiment, the upcoming activity LED display may be color coded based on activity type, e.g. local appointment is yellow, remote appointment is red, scheduled activity is green, etc. In one embodiment, this display is based on the user's calendar data from the user's mobile device. In one embodiment, the display may be configurable by the user. In one embodiment, such configuration is done on a paired mobile device or computer system, so that the user need not program the band with a limited interface. In one embodiment, the configuration may be done via verbal instructions. In one embodiment, the configuration may be done on a webpage, accessible via the Internet.

In one embodiment, if none of these states are detected, the device is idle, e.g. not being worn by the user. In one embodiment, at block 360, the LEDs or other displays are slowly faded out, and the device is placed in a low power state. This ensures that the batteries last a long time. The process then returns to block 320, to continue identifying the current state.

Of course, though this is shown as a flowchart, in one embodiment it is implemented as an interrupt-driven system, such that the device state is changed when a state detection system identifies a change of the state. Additionally, the ordering of state checking is arbitrary. One embodiment of state identification is described with respect to FIG. 4.

Figure 4:
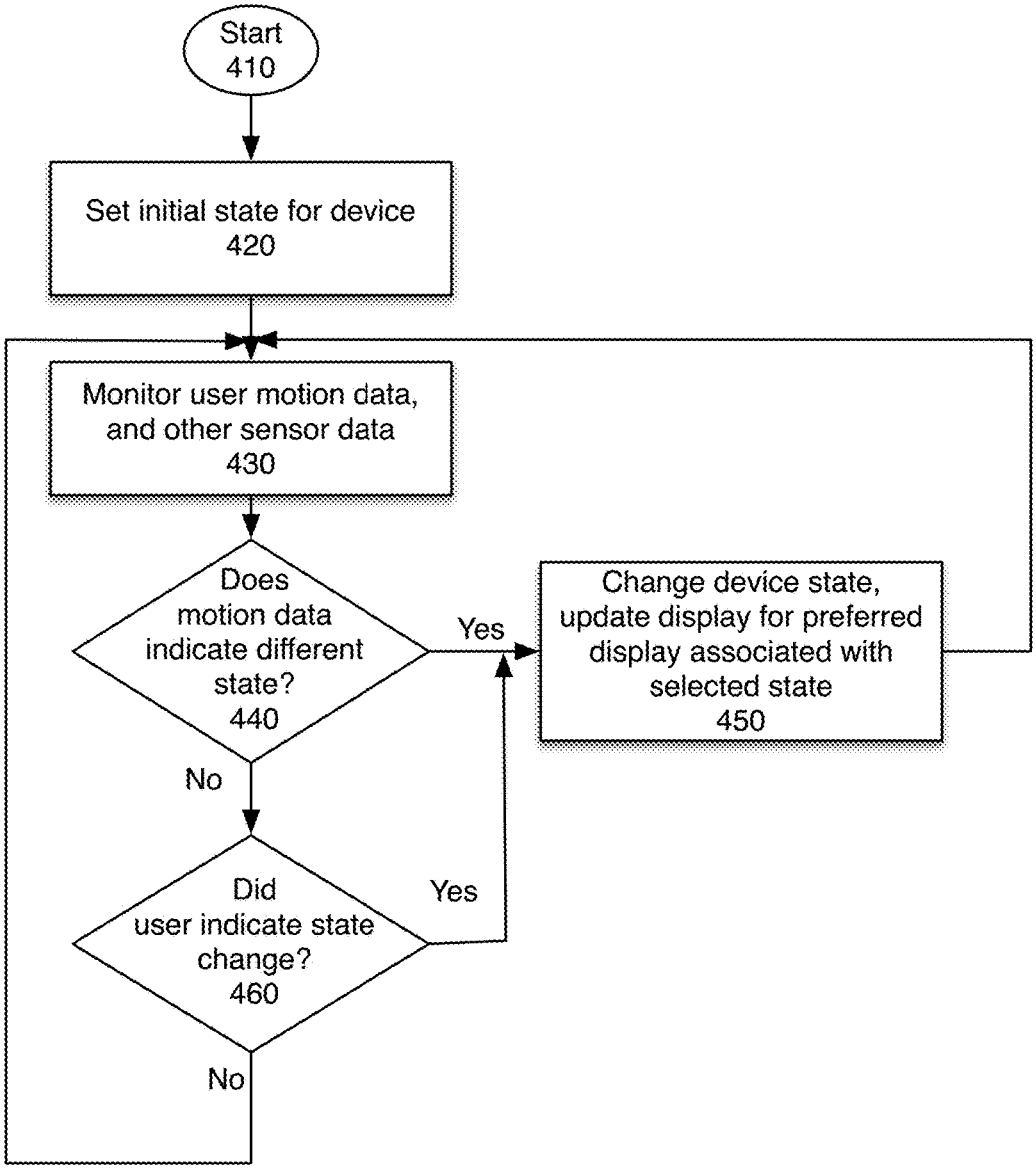
FIG. 4 is a flowchart of one embodiment of selecting the state.

FIG. 4 is a flowchart of one embodiment of selecting the state. In one embodiment, this corresponds to block 320 of FIG. 3.

At block 420, the process sets the initial state for the device. In one embodiment, the initial state is based on a local time, e.g. the device assumes the user is active during daytime hours, and the user is sleeping during nighttime hours. In one embodiment, the user may set the default initial state.

At block 430, the system monitors the user motion data and other sensor data. In one embodiment, the monitoring may use one or more sensors in the band, or in an associated mobile device and/or sensor. In one embodiment, the band includes an accelerometer or similar motion sensor. Additional sensors may include temperature sensors, barometric pressure sensors, gyroscopes, etc.

At block 440, the process determines whether the motion data indicates a different state. If so, at block 450 the device state is changed, to match the state indicated by the motion and sensor data. Changing the device state also includes updating the display for the preferred display associated with the state. In one embodiment, the user may choose the preferred display presented in each state. FIG. 5 illustrates some exemplary data sets that may be shown to the user, for configuring the user interface. In one embodiment, the (v1) indicated in FIG. 5 is the default user interface display for each state. In one embodiment, the user may reconfigure his or her device, according to preferences. In one embodiment, the user may configure the device to enable switching through the possible displays, using either a motion command (e.g. shaking the device, tapping the device, etc.) or a button or other user interface input.

In one embodiment, the device may show multiple sets of data in a single circle/concentric polygon shape. For example, in a multi-color LED system, one set of colors may indicate the current time, while another color is being used as a count-down timer. For example, the white LED may be used as a the hour & minute hand of a display, while a moving red LED is used as a countdown timer.

The process then returns to block 430 to continue monitoring the motion and other sensor data.

If the motion does not indicate a different state, at block 460 the process determines whether the user has indicated a state change. The user may change the device state by pressing a button, performing an gesture (e.g. tapping the device, shaking the device, etc.), or otherwise indicating that he or she wishes the device to change state. In one embodiment, the device may accept voice control, or control by a remote device such as the user's mobile phone.

If the user did not indicate a state change, the process returns to block 430 to continue monitoring the motion and sensor data. If the user did indicate a state change, the process continues to block 450, to change the device state and update the display for the preferred display associated with the state.

Of course, though this is shown as a flowchart, in one embodiment it is implemented as an interrupt-driven system, such that the device state is changed when a state detection system identifies a change of the state. Additionally, the ordering of state checking is arbitrary.

Figure 6:
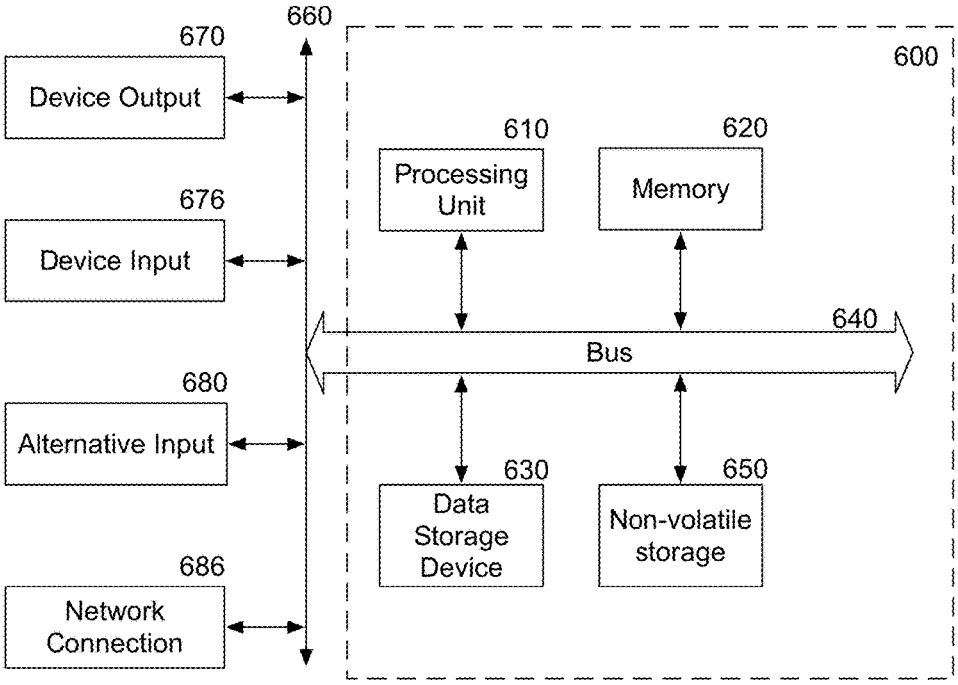
FIG. 6 is a block diagram of one embodiment of a computer system that may be used with the present invention.

FIG. 6 is a block diagram of one embodiment of a computer system that may be used with the present invention. It will be apparent to those of ordinary skill in the art, however that other alternative systems of various system architectures may also be used. The computer system utilized in the band may be a special purpose processor to obtain data about the user, and control the user interface.

The data processing system illustrated in FIG. 6 includes a bus or other internal communication means 640 for communicating information, and a processing unit 610 coupled to the bus 640 for processing information. The processing unit 610 may be a central processing unit (CPU), a digital signal processor (DSP), or another type of processing unit 610.

The system further includes, in one embodiment, a random access memory (RAM) or other volatile storage device 620 (referred to as memory), coupled to bus 640 for storing information and instructions to be executed by processor 610. Main memory 620 may also be used for storing temporary variables or other intermediate information during execution of instructions by processing unit 610.

The system also comprises in one embodiment a read only memory (ROM) 650 and/or static storage device 650 coupled to bus 640 for storing static information and instructions for processor 610. In one embodiment, the system also includes a data storage device 630 such as a magnetic disk or optical disk and its corresponding disk drive, or Flash memory or other storage which is capable of storing data when no power is supplied to the system. Data storage device 630 in one embodiment is coupled to bus 640 for storing information and instructions.

The system may further be coupled to an output device 670, such as a cathode ray tube (CRT) or a liquid crystal display (LCD) coupled to bus 640 through bus 660 for outputting information. The output device 670 may be a visual output device, an audio output device, and/or tactile output device (e.g. vibrations, etc.)

An input device 675 may be coupled to the bus 660. The input device 675 may be an alphanumeric input device, such as a keyboard including alphanumeric and other keys, for enabling a user to communicate information and command selections to processing unit 610. An additional user input device 680 may further be included. One such user input device 680 is cursor control device 680, such as a mouse, a trackball, stylus, cursor direction keys, or touch screen, may be coupled to bus 640 through bus 660 for communicating direction information and command selections to processing unit 610, and for controlling movement on display device 670. In one embodiment, the user input device 680 may be a motion sensor, enabling the use of motion commands.

Another device, which may optionally be coupled to computer system 600, is a network device 685 for accessing other nodes of a distributed system via a network. The communication device 685 may include any of a number of commercially available networking peripheral devices such as those used for coupling to an Ethernet, token ring, Internet, or wide area network, personal area network, wireless network or other method of accessing other devices. The communication device 685 may further be a null-modem connection, or any other mechanism that provides connectivity between the computer system 600 and the outside world.

Note that any or all of the components of this system illustrated in FIG. 6 and associated hardware may be used in various embodiments of the present invention.

It will be appreciated by those of ordinary skill in the art that the particular machine that embodies the present invention may be configured in various ways according to the particular implementation. The control logic or software implementing the present invention can be stored in main memory 620, mass storage device 630, or other storage medium locally or remotely accessible to processor 610.

It will be apparent to those of ordinary skill in the art that the system, method, and process described herein can be implemented as software stored in main memory 620 or read only memory 650 and executed by processor 610. This control logic or software may also be resident on an article of manufacture comprising a computer readable medium having computer readable program code embodied therein and being readable by the mass storage device 630 and for causing the processor 610 to operate in accordance with the methods and teachings herein.

The present invention may also be embodied in a handheld or portable device containing a subset of the computer hardware components described above. For example, the handheld device may be configured to contain only the bus 640, the processor 610, and memory 650 and/or 620.

The handheld device may be configured to include a set of buttons or input signaling components with which a user may select from a set of available options. These could be considered input device #1 675 or input device #2 680. The handheld device may also be configured to include an output device 670 such as a liquid crystal display (LCD) or display element matrix for displaying information to a user of the handheld device. Conventional methods may be used to implement such a handheld device. The implementation of the present invention for such a device would be apparent to one of ordinary skill in the art given the disclosure of the present invention as provided herein.

The present invention may also be embodied in a special purpose appliance including a subset of the computer hardware components described above, such as a kiosk or a vehicle. For example, the appliance may include a processing unit 610, a data storage device 630, a bus 640, and memory 620, and no input/output mechanisms, or only rudimentary communications mechanisms, such as a small touch-screen that permits the user to communicate in a basic manner with the device. In general, the more special-purpose the device is, the fewer of the elements need be present for the device to function. In some devices, communications with the user may be through a touch-based screen, or similar mechanism. In one embodiment, the device may not provide any direct input/output signals, but may be configured and accessed through a website or other network-based connection through network device 685.

It will be appreciated by those of ordinary skill in the art that any configuration of the particular machine implemented as the computer system may be used according to the particular implementation. The control logic or software implementing the present invention can be stored on any machine-readable medium locally or remotely accessible to processor 610. A machine-readable medium includes any mechanism for storing information in a form readable by a machine (e.g. a computer). For example, a machine readable medium includes read-only memory (ROM), random access memory (RAM), magnetic disk storage media, optical storage media, flash memory devices, or other storage media which may be used for temporary or permanent data storage. In one embodiment, the control logic may be implemented as transmittable data, such as electrical, optical, acoustical or other forms of propagated signals (e.g. carrier waves, infrared signals, digital signals, etc.).

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

We claim:

1. A multi-use band comprising:

a user interface including:

a first shape including a first plurality of light sources;

a second shape including a second plurality of light sources; and a state display to display a device state, the device state including: an inactive state, a user state selected from a user active state and a user sleep state, and a clock display state;

the first shape and the second shape being concentric rings;

the state display positioned in a center of the concentric rings;

a state system to determine the device state, and to provide feedback on a current performance of a user for the user state using the first plurality of light sources and the second plurality of light sources when the device state is the user state; and a clock system to provide a current time using the using the first plurality of light sources and the second plurality of light sources when the device is in the clock display state.

2. The multi-use band of claim 1, wherein the first and the second plurality of light sources are selected from among: light emitting diodes (LEDs), organic LEDs, polymer LEDs, and liquid crystal displays.

3. The multi-use band of claim 1, wherein the device state comprises one of: inactive, the active, sleeping, and the clock display state.

4. The method of claim 3, wherein the state display comprises:

no lights for the inactive state, walking figure for the active state, moon for the sleeping state, and clock face for the clock display state.

5. The multi-use band of claim 1, wherein the feedback on the current performance of the user comprises: an activity level for the active state, and one of a sleep phase and a sleep quality for the sleep state.

6. A multi-use band comprising:

a plurality of light emitting diodes to display data arranged in a shape;

a state system to determine a device state, the device state including a user active state, a user sleep state, and a clock display state; and a user interface including a state display to indicate the device state, and utilizing the plurality of light emitting diodes to provide feedback on a current performance of a user when the multi-user band is in the active state, to provide information about a sleep of the user in the user sleep state, and to provide a current time in the clock display state, wherein the state display comprises: no lights for the inactive state, walking figure for the active state, moon for the sleeping state, and clock face for the clock display state.

7. The multi-use band of claim 6, wherein the shape is selected from among: curvilinear shapes, polygonal shapes, irregular shapes.

8. The multi-use band of claim 6, further comprising:

a second shape with a second plurality of light emitting diodes, wherein the shape and the second shape are concentric.

9. The multi-use band of claim 6, wherein the plurality of light emitting diodes are selected from among: light emitting diodes (LEDs), organic LEDs, and polymer LEDs.

10. The multi-use band of claim 6, wherein the device state comprises one of: inactive, the active, sleeping, and the clock display state.

11. The multi-use band of claim 6, further comprising:

the first shape and the second shape being concentric rings;

the state display positioned in a center of the concentric rings.

12. The multi-use band of claim 6, wherein the feedback on the current performance of the user comprises: an activity level for the active state, and one of a sleep phase and a sleep quality for the sleep state.

13. A method of providing a multi-use band comprising:

determine a device state;

display the device state using a device state indicator, wherein the device state indicator comprises: no lights for the inactive state, walking figure for the active state, moon for the sleeping state, and clock face for the clock display state;

display feedback on a current performance of a user in a first device state, and display a current time in a second device state, utilizing a user interface including a first shape including a first plurality of light sources and a second shape including a second plurality of light sources.

14. The method of claim 13, wherein the first shape and the second shape are selected from among: curvilinear shapes, polygonal shapes, irregular shapes.

15. The method of claim 14, wherein:

the first shape and the second shape are concentric rings; and the state display is positioned in a center of the concentric rings.

16. The method of claim 13, wherein the first shape and the second shape are concentric.

17. The method of claim 13 wherein the first and the second plurality of light sources are selected from among: light emitting diodes (LEDs), organic LEDs, polymer LEDs, and liquid crystal displays.

18. The method of claim 13, wherein the device state comprises one of: inactive, active, sleeping, and clock display.

19. The method of claim 13, wherein the feedback on the current performance of the user comprises: an activity level for the active state, and one of a sleep phase and a sleep quality for the sleep state.

* * * * *